US007628743B1

(12) United States Patent
Flentye et al.

(10) Patent No.: US 7,628,743 B1
(45) Date of Patent: Dec. 8, 2009

(54) RESISTANCE EXERCISE DEVICE

(75) Inventors: Herbert T. Flentye, Glenview, IL (US); Gregory Niederlander, Gurnee, IL (US)

(73) Assignee: Spri Products, Inc., Libertyville, IL (US)

( * ) Notice: Subject to any disclaimer, the term of this patent is extended or adjusted under 35 U.S.C. 154(b) by 0 days.

(21) Appl. No.: 12/327,416

(22) Filed: Dec. 3, 2008

(51) Int. Cl.
*A63B 21/02* (2006.01)

(52) U.S. Cl. ..... 482/126; 482/121

(58) Field of Classification Search ..... 482/39–40, 482/121–126, 81–82, 74
See application file for complete search history.

(56) References Cited

U.S. PATENT DOCUMENTS

| | | | |
|---|---|---|---|
| 232,579 | A | 9/1880 | Weeks |
| 425,636 | A | 4/1890 | Shaw |
| 1,112,114 | A | 9/1914 | Caines |
| 1,965,511 | A | 7/1934 | Preston |
| 2,680,967 | A | 6/1954 | Newman |
| 3,103,357 | A | 9/1963 | Berne |
| 3,288,413 | A | 11/1966 | Gregory |
| 3,415,515 | A | 12/1968 | Otto |
| 3,430,953 | A | 3/1969 | Teetor |
| 3,587,319 | A | 6/1971 | Andrews |
| 3,643,947 | A | 2/1972 | Collins |
| 3,659,844 | A | 5/1972 | Cummins |
| 3,847,422 | A | 11/1974 | Gulistan |
| 3,923,302 | A | 12/1975 | Boggild |

(Continued)

FOREIGN PATENT DOCUMENTS

DE 2004-006483 U1 8/2004

(Continued)

OTHER PUBLICATIONS

Sporttime—"The Big Red Base System"; Catalog; 44-49 and 203 (Spring 2001).

(Continued)

*Primary Examiner*—Fenn C Mathew
(74) *Attorney, Agent, or Firm*—Barnes & Thornburg LLP

(57) ABSTRACT

A resistance exercise device comprising: at least one handle defining a plurality of holes; a cord having a pair of ends and a length extending between the pair of ends, the handle being secured to one of the ends of the cord, the cord being stretchable from a relaxed state to extend the length of the cord, the cord comprising a plurality of tubes extending substantially the entire length of the cord and having a pair of ends, the tubes being conjoined together along substantially the entire length of the cord by means of braiding, each tube received by a respective hole of the handle adjacent one of the ends of the tube; and structure engaging each tube to the handle adjacent the one end of the tube to prevent the tube from disengaging from the handle by preventing the one end of the tube from passing through the respective hole of the handle. The structure may comprise a plurality of plugs or other enlarged elements or any other suitable structure secured to a respective tube adjacent the one end of the respective tube to prevent the one end of the respective tube from disengaging from the handle. The handle may comprise one or more bores contiguous with each hole.

17 Claims, 4 Drawing Sheets

U.S. PATENT DOCUMENTS

| | | | |
|---|---|---|---|
| 3,956,911 | A | 5/1976 | Carboud |
| 3,984,136 | A | 10/1976 | Bills |
| 4,018,437 | A | 4/1977 | LoPresti |
| 4,109,907 | A | 8/1978 | Zito |
| 4,113,221 | A | 9/1978 | Wehner |
| 4,182,510 | A | 1/1980 | Lundell |
| 4,185,816 | A | 1/1980 | Bernstein |
| 4,212,458 | A | 7/1980 | Bizilia |
| 4,266,766 | A | 5/1981 | Calderone |
| 4,330,131 | A | 5/1982 | Warehime |
| 4,357,010 | A | 11/1982 | Telle |
| 4,412,677 | A | 11/1983 | Viramontes |
| 4,419,990 | A | 12/1983 | Forster |
| D277,218 | S | 1/1985 | Hinds |
| 4,572,505 | A | 2/1986 | Kornhaus |
| 4,662,629 | A | 5/1987 | Plovie |
| 4,720,099 | A | 1/1988 | Carlson |
| 4,733,862 | A | 3/1988 | Miller |
| 4,749,185 | A | 6/1988 | Spears |
| 4,779,867 | A | 10/1988 | Hinds |
| 4,787,626 | A | 11/1988 | Gallagher |
| 4,809,971 | A | 3/1989 | Goldish |
| 4,848,741 | A | 7/1989 | Hermanson |
| 4,944,518 | A | 7/1990 | Flynn |
| 5,135,445 | A | 8/1992 | Christensen |
| 5,152,728 | A | 10/1992 | Podd |
| 5,176,602 | A | 1/1993 | Roberts |
| 5,183,452 | A | 2/1993 | Bacon |
| 5,230,676 | A | 7/1993 | Terauds |
| 5,342,274 | A | 8/1994 | Hunker |
| 5,354,253 | A | 10/1994 | Awbrey |
| 5,372,556 | A | 12/1994 | Ropp |
| 5,393,286 | A | 2/1995 | Cheng |
| 5,407,414 | A | 4/1995 | Bass |
| 5,431,617 | A | 7/1995 | Rattray |
| 5,468,205 | A | 11/1995 | McFall et al. |
| 5,505,677 | A | 4/1996 | Hinds |
| 5,514,059 | A | 5/1996 | Rumney |
| 5,540,643 | A | 7/1996 | Fontaine |
| 5,549,528 | A | 8/1996 | Bryant |
| 5,549,532 | A | 8/1996 | Kropp |
| 5,554,088 | A | 9/1996 | Zlojutro |
| 5,571,064 | A | 11/1996 | Holm |
| 5,603,681 | A | 2/1997 | Olschansky |
| 5,626,546 | A | 5/1997 | Little |
| 5,676,627 | A | 10/1997 | Howse |
| 5,690,595 | A | 11/1997 | Quinones |
| 5,716,308 | A | 2/1998 | Lee |
| 5,720,701 | A | 2/1998 | Truini |
| 5,720,702 | A | 2/1998 | Lee |
| 5,769,734 | A | 6/1998 | Qualey, Sr. |
| 5,792,032 | A | 8/1998 | Williams |
| 5,800,322 | A | 9/1998 | Block |
| 5,800,323 | A | 9/1998 | Ansel |
| 5,885,190 | A | 3/1999 | Reiter |
| 5,895,343 | A | 4/1999 | Huang |
| 6,001,048 | A | 12/1999 | Taylor |
| 6,036,625 | A | 3/2000 | Woodruff |
| 6,063,010 | A | 5/2000 | Howd et al. |
| 6,080,089 | A | 6/2000 | Nicholson |
| 6,120,421 | A | 9/2000 | Koo |
| 6,202,263 | B1 | 3/2001 | Harker |
| 6,206,811 | B1 | 3/2001 | Lat |
| 6,254,517 | B1 | 7/2001 | Kennedy |
| 6,267,711 | B1 | 7/2001 | Hinds |
| 6,319,179 | B1 | 11/2001 | Hinds |
| 6,322,483 | B1 | 11/2001 | Rotella |
| 6,348,026 | B1 | 2/2002 | Kuo |
| 6,450,930 | B1 | 9/2002 | Kroke |
| 6,500,102 | B1 | 12/2002 | Domenge |
| 6,524,226 | B2 | 2/2003 | Kushner |
| 6,726,601 | B1 | 4/2004 | Beutel |
| 6,840,894 | B2 | 1/2005 | Lerner |
| 6,860,841 | B1 | 3/2005 | Mortorano |
| 7,025,644 | B2 | 4/2006 | Geier et al. |
| 7,169,094 | B2 | 1/2007 | Ardito |
| 7,503,883 | B2 * | 3/2009 | Madden ..... 482/126 |
| 2002/0187884 | A1 | 12/2002 | McGrath |
| 2003/0096684 | A1 | 5/2003 | Combes et al. |
| 2004/0152569 | A1 | 8/2004 | Lerner |
| 2006/0258519 | A1 | 11/2006 | Ardito |
| 2007/0054789 | A1 | 3/2007 | Ardito |
| 2007/0155600 | A1 | 7/2007 | Cunningham et al. |

FOREIGN PATENT DOCUMENTS

| | | |
|---|---|---|
| WO | WO 03-000348 | 1/2003 |
| WO | WO 2004-033051 | 4/2004 |

OTHER PUBLICATIONS

PowerVertex; "Kinetic Link Training"; website, http://www.powervertex.com/kttraining.htm (2007).

* cited by examiner

RESISTANCE EXERCISE DEVICE

BACKGROUND AND SUMMARY

The present disclosure relates to a resistance exercise device.

Use of rubber resistance exercise tubes in connection with a wide variety of exercises is well known in the health and fitness industry. The rubber resistance exercise tubes are in the form of hollow tubes that provide resistance in response to stretching of the tubes. The amount of resistance typically depends upon the thickness of the tubes. Handles or other structure are secured to the resistance tube to provide exercise features and options.

The present disclosure relates to a resistance exercise device comprising: at least one handle defining a plurality of holes; a cord having a pair of ends and a length extending between the pair of ends, the handle being secured to one of the ends of the cord, the cord being stretchable from a relaxed state to extend the length of the cord, the cord comprising a plurality of tubes extending substantially the entire length of the cord and having a pair of ends, the tubes being conjoined together along substantially the entire length of the cord by means of braiding, each tube received by a respective hole of the handle adjacent one of the ends of the tube; and structure engaging each tube to the handle adjacent the one end of the tube to prevent the tube from disengaging from the handle by preventing the one end of the tube from passing through the respective hole of the handle. The structure may comprise a plurality of plugs or other enlarged elements or any other suitable structure secured to a respective tube adjacent the one end of the respective tube to prevent the one end of the respective tube from disengaging from the handle. The handle may comprise one or more bores contiguous with each hole.

In accordance with other embodiments, the resistance exercise device may comprise: at least one handle defining a plurality of holes, a plurality of first bores having first bore diameters, and a plurality of second bores having second bore diameters smaller than the first bore diameters, each second bore contiguous with and interconnecting a respective first bore and a respective hole; a cord having a pair of ends and a length extending between the pair of ends, the cord being stretchable from a relaxed state to extend the length of the cord, the cord comprising a plurality of tubes extending substantially the entire length of the cord, the tubes being conjoined together along substantially the entire length of the cord by means of braiding, each tube received by the respective hole of the handle and the respective first and second bores, each tube defines a channel at the one end of the cord; and a plurality of plugs for securing the handle to one end of the cord, each plug received by the channel of a respective tube expanding a portion of the respective tube to a dimension greater than the second bore diameters but less than the first bore diameters, the expanded portion of the respective tube receivable by the respective first bore, each plug sized to prevent the respective tube from disengaging from the handle by preventing the expanded portion of the respective tube from passing through the respective second bore.

Additional features of the present disclosure will become apparent to those skilled in the art upon consideration of the following detailed description of illustrative embodiments of the disclosure.

BRIEF DESCRIPTION OF THE DRAWINGS

The detailed description particularly refers to the accompanying figures in which.

DETAILED DESCRIPTION OF THE ILLUSTRATED EMBODIMENT

Figure 1:
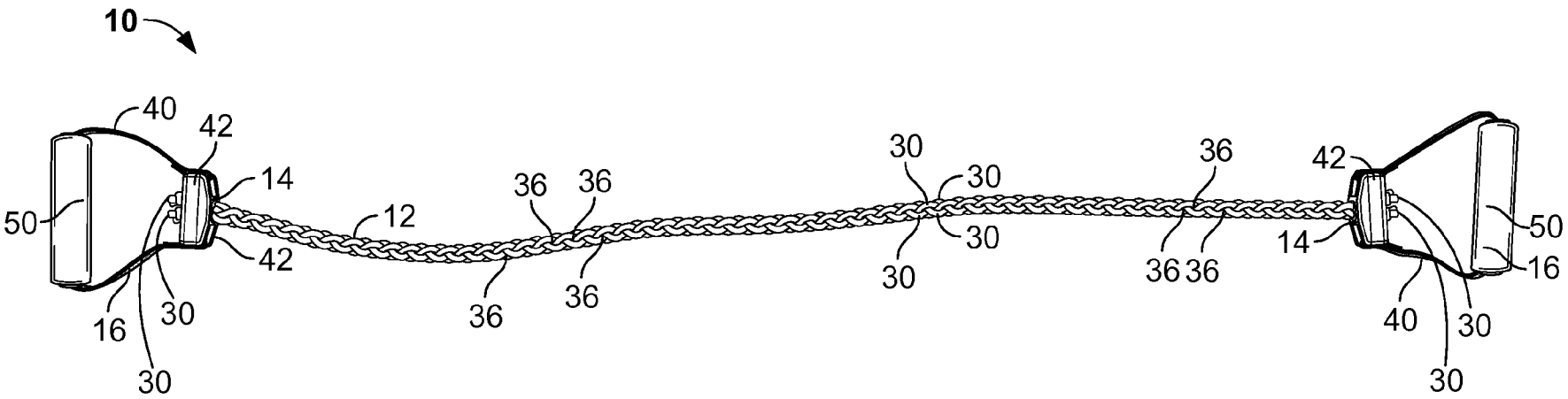
FIG. 1 is a perspective view of a resistance exercise device in accordance with an embodiment of the present disclosure, illustrating the cord of the resistance exercise device in a relaxed state.

While the present disclosure may be susceptible to embodiment in different forms, there is shown in the drawing, and herein will be described in detail, an embodiment with the understanding that the present description is to be considered an exemplification of the principles of the disclosure and is not intended to limit the disclosure to the details of construction and the arrangements of components set forth in the following description or illustrated in the drawing.

Figure 2:
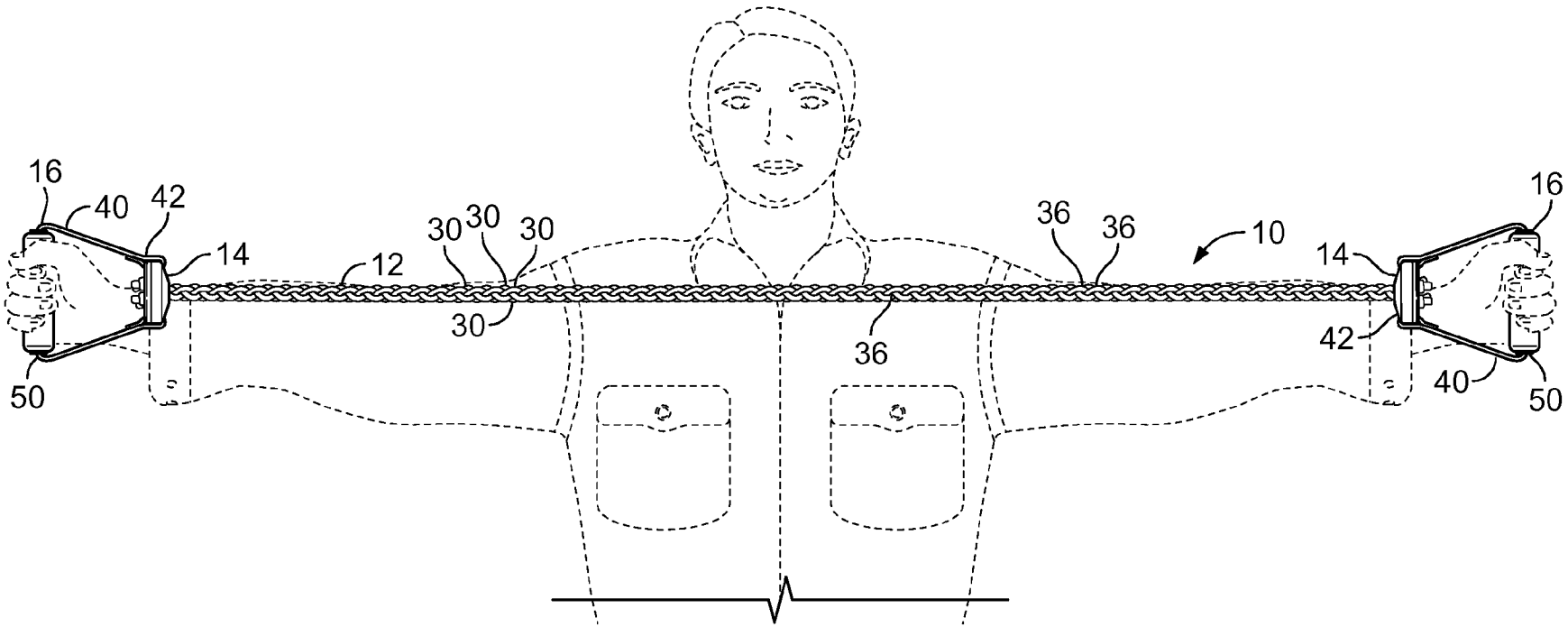
FIG. 2 is a perspective view of the resistance exercise device of FIG. 1 illustrating the cord pulled by a user to a stretched state.
Figure 3:
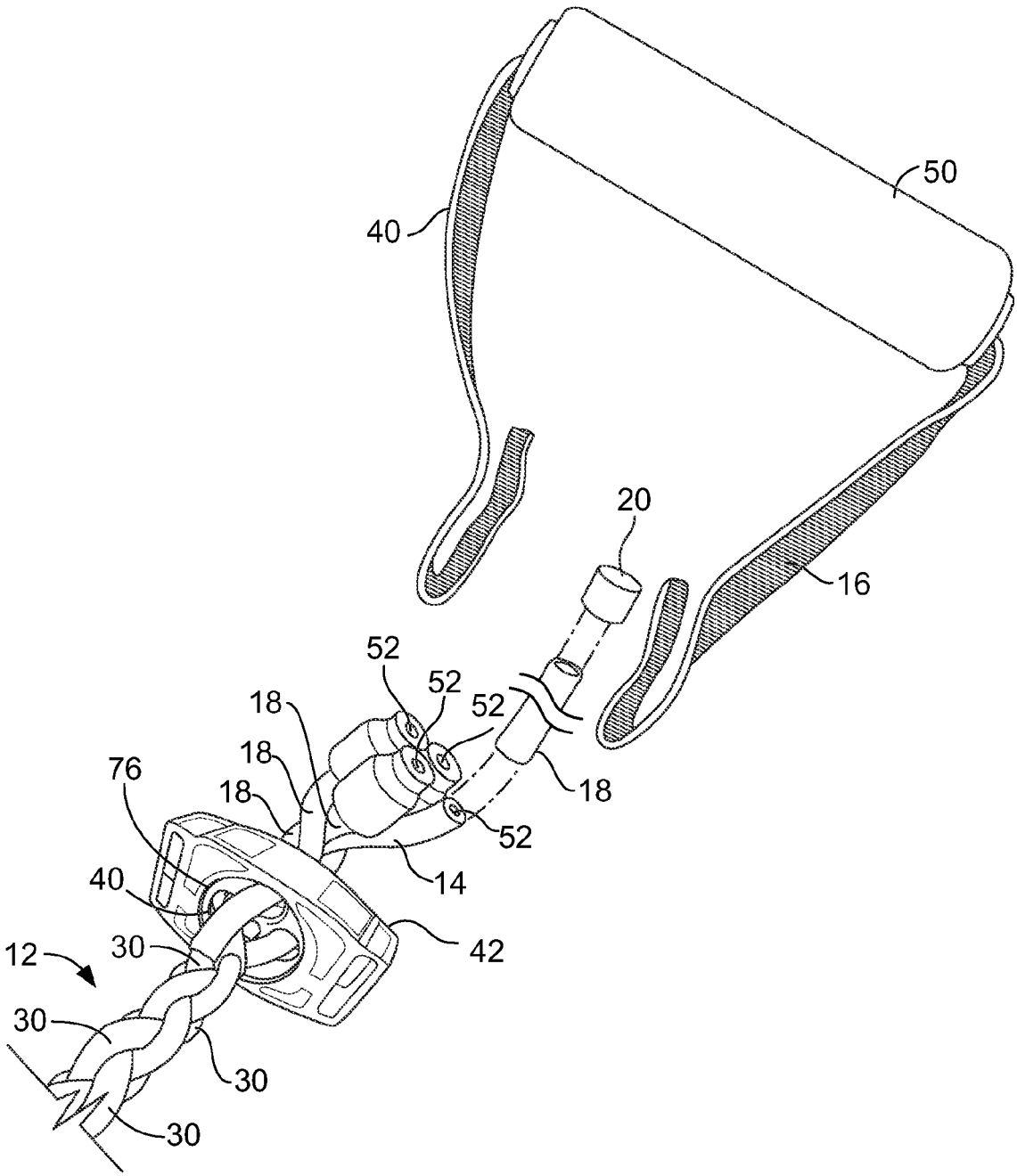
FIG. 3 is an exploded perspective view of one of the ends of the resistance exercise device of FIG. 1.
Figure 4:
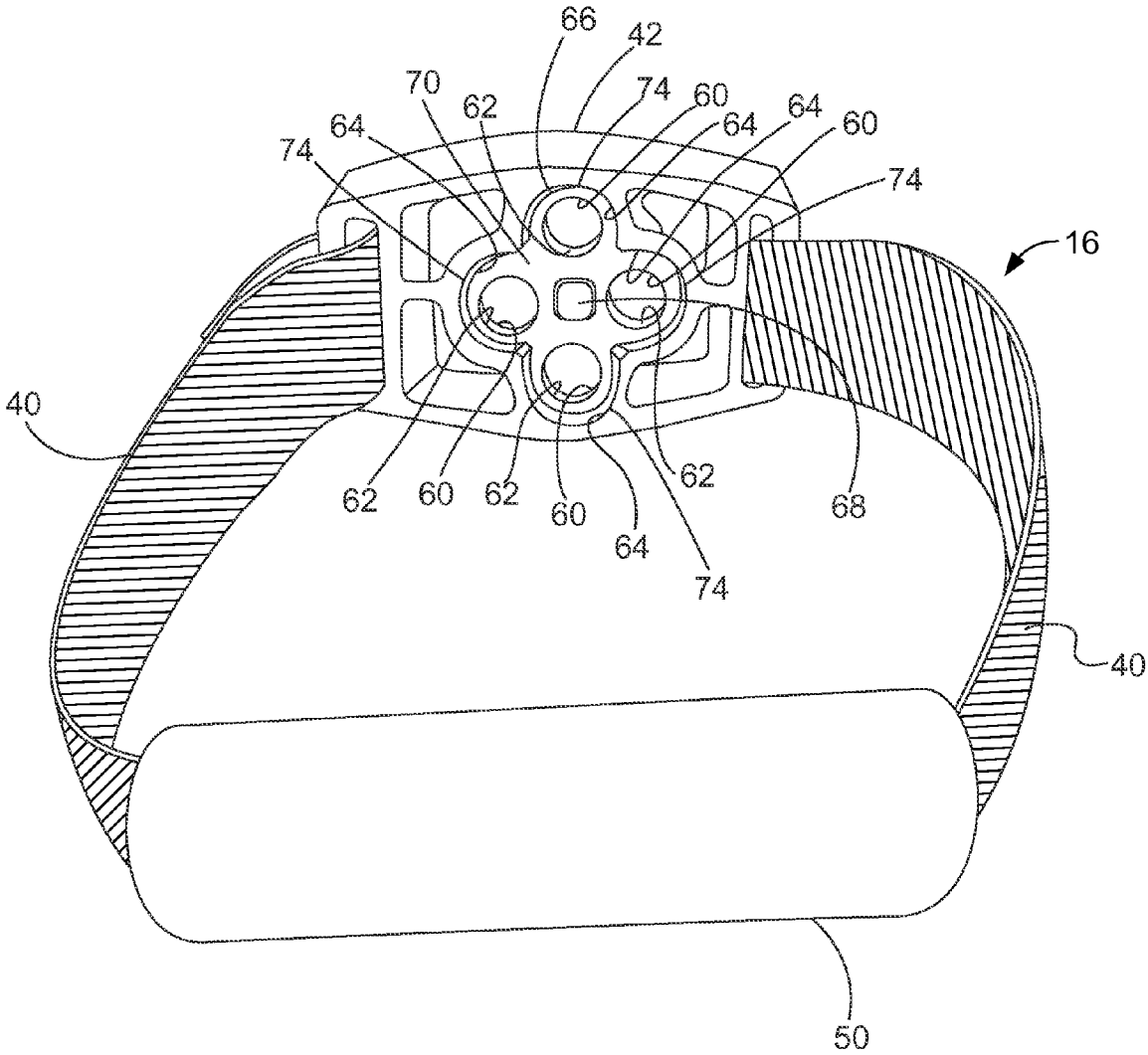
FIG. 4 is a perspective view of one of the handles of the exercise device of FIG. 1.

FIGS. 1-3 illustrate a resistance exercise device 10 in accordance with an embodiment of the present disclosure. The illustrated resistance exercise device 10 comprises generally a cord 12 having a pair of ends 14, a pair of handles 16, a plurality of sleeves 18 and structure for engaging the cord to the handle in the form of a plurality of plugs 20.

The cord 12 is shown in a relaxed state in FIG. 1, but can be stretched by application of any suitable pulling force during any type of exercise as shown, for example, in FIG. 2 to extend the length of the cord. The extent of stretching of the cord 12 depends upon the magnitude of the pulling force and the resistance of the cord 12.

The illustrated cord 12 comprises four hollow, elongated resistance tubes 30 conjoined together by means of braiding substantially the entire length of the cord. The braiding is snug such that when the cord is in either a relaxed state or stretched state each resistance tube 30 is in contact with one or more of the other resistance tubes 30 along the entire length or substantially the entire length of the cord 12. With such construction, even when the cord is in a relaxed state, there are no openings along the length of the cord 12 except perhaps for small openings 36 defined adjacent the starting and ending points of contact between each pair of resistance tubes 30 which occur intermittently along the length of the cord. The cord 12 may be formed by more or less than four resistance tubes 30 in accordance with other embodiments of the present disclosure.

The illustrated resistance tubes 30 are constructed of rubber and may have any suitable dimensions. Each of the resistance tubes 30 may have any suitable construction, configuration and dimensions. The resistance tubes 30 may, for example, be any commercially available rubber resistance tube. The thickness of the tubes 30 affects the amount of resistance provided by the cord 12 during exercise.

The handles 16 may have any suitable construction, configuration and dimensions and may be secured to the ends of the cord 12 in any suitable manner. In the illustrated embodiment, for example, each handle 16 comprises a fabric strip 40, an engaging member 42, and a tubular hand grip 50 disposed about the fabric strip. The fabric strip 40 includes a pair of ends, with each end being secured to a respective side of the engaging member 42 by looping the end about a portion of the engaging member and stitching the end of the fabric strip or by any other suitable means such that the fabric strip and the engaging member 42 form a loop.

The engaging member 42 defines a plurality of holes 60 and a plurality of pairs of bores 62 and 64. Each pair of bores 62 and 64 is contiguous with each other and with a respective one of the holes 60. Bores 62 are generally tubular. Bores 64 are defined by a wall 66, a separating member 68 and a rim 70 formed on the engaging member 42. Each bore 64 is generally tubular along about ½ of its diameter and is contiguous with other bores 64 along most of the other ½ of its diameter. Each bore 64 has a partial tubular construction in that it is defined by an arcuate portion 74 of the wall 64, and, thus, each bore has a diameter as measured across the bore 64 between the pair of opposed ends of the arcuate portion defining the bore. The diameter of the bore 62 may be substantially the same as or more or less than the diameter of the holes 60. A circular bore 76 is defined on the other side of the engaging member 42 disposed about the holes 60, and the engaging member 42 also includes cut outs for manufacturing cost benefits.

Each plug 20 is received by a channel 52 defined along the length of a respective tube 30 at or adjacent an end of the tube. Each plug 20 expands a portion of the respective tube 30 to be greater than the diameters of the holes 60 and the bores 62 but less than the diameters of the bores 64. Each sleeve 18 may be disposed about a respective end of one of the tubes 30. The plugs 20 adjacent each end of the cord 12 thereby also expand a portion of the cord 12 and a portion of the respective sleeve 18 disposed about the plug. The hole 60 of the respective handle 16 is proximal of the plugs 20 adjacent each end of the cord 12. As a result, the plugs 20 at each end prevent the respective handle 16 from disengaging from the cord 12 by preventing the ends of the tubes 30 from passing through bores 62 and hole 60 and thus preventing respective engaging member 42 from moving distally of the plugs. The sleeves 18 protect the tubes 30 from the wear and tear associated with the constant pulling of the handles 16.

The plugs 20 are sized such that the expanded portion of the tubes 30 cannot pass through the respective hole 60 and the bore 62 to prevent the tubes from disengaging from the handles 16. The illustrated plugs 20 are generally tubular and have a diameter greater than the diameter of the bore 62 but less than the diameter of the bore 64. As the cord 12 is stretched, the expanded portions of the tubes 30 are received by the bores 64 and the plugs 20 engage the rim 70. The tubes 30 thus may be slidable relative to the handle 16 before such engagement with the rim 70, or may be rigidly retained in place in accordance with other embodiments.

The plugs 20 and the sleeve 18 may be constructed of any suitable rubber or other material. For example, the plugs 20 may be constructed of a hard or compressed rubber or other rigid material and the sleeve 18 may be constructed of any suitable rubber or other elastic material. The plugs 20 may also have any other suitable configuration in accordance with other embodiments of the present disclosure.

Additionally, any other structure can be used to engage the tubes 30 to the handles 16 to prevent the tubes from sliding through the holes 60 and bores 62 of the handles. For example, the plugs 20 may instead be in the form of any other type of enlarged elements that prevent the ends of the tubes 30 from disengaging from the handle 16 by preventing the ends of the tubes from sliding through the holes 60 and the bores 62 of the handles. As a further alternative, the structure may instead or in addition be a single structure that prevents the ends of the tubes 30 from disengaging from the handle 16 by preventing the ends of the tubes from sliding through the holes 60 and the bores 62 of the handles.

The handles 16 may have any other structure and may be secured to the cord 12 in any other suitable manner in accordance with other embodiments of the present disclosure. The handles 16, for example, may instead be in the form of the handles disclosed in U.S. Pat. No. 5,800,322 or may instead comprise any other type of strip 40 or any other type of structure. The strip 40 or other structure may be constructed of any suitable material and have any suitable configuration. Similarly, each of the engaging member 42, the hand grip 50, the sleeve 18, and the plugs 20 may have any other suitable construction or configuration or may be omitted in accordance with other embodiments. Further, any suitable other structure may be secured to the cord 12 or the handle 16 in accordance with other embodiments of the present disclosure.

The resistance exercise device 10 can be used in connection with a wide variety of exercises, including, for example, any type of exercise relating to strength training, core conditioning, stability and stretching. The resistance exercise device 10 can also be used in any suitable manner. Countless exercises can be performed with the resistance exercise device 10.

An advantage of the resistance exercise device 10 in accordance with the present disclosure is that it remains intact even if one of the resistance tubes 30 breaks. With the prior art resistance exercise devices, if the cord breaks, the resistance exercise device does not remain intact. With the resistance exercise device 10 in accordance with the present disclosure, however, if one of the resistance tubes 30 breaks during use, the resistance exercise device remains intact thus reducing if not eliminating any risk resulting from breakage of the cord.

The handles 16 and the structure for engaging the handles to the cords 30 in accordance with the present disclosure provide additional benefits. For example, the handles and structure provide a durable and secure connection during use of the exercise device. The handles 16 and structure may also provide manufacturing cost benefits.

While the concepts of the present disclosure have been illustrated and described in detail in the drawings and foregoing description, such an illustration and description is to be considered as exemplary and not restrictive in character, it being understood that only the illustrative embodiment has been shown and described and that all changes and modifications that come within the spirit of the disclosure are desired to be protected by the following claims:

The invention claimed is:

1. A resistance exercise device comprising:

at least one handle defining a plurality of holes;

a cord having a pair of ends and a length extending between the pair of ends, the handle being secured to one of the ends of the cord, the cord being stretchable from a relaxed state to extend the length of the cord, the cord comprising a plurality of tubes extending substantially the entire length of the cord and having a pair of ends, the tubes being conjoined together along substantially the entire length of the cord by means of braiding, each tube received by a respective hole of the handle adjacent one of the ends of the tube;

a plurality of enlarged elements, each enlarged element secured to a respective tube adjacent the one end of the respective tube to prevent the respective tube from disengaging from the handle by preventing the one end of the respective tube from passing through the respective hole by virtue of the respective enlarged element being larger than the respective hole; and wherein the handle defines a plurality of first bores and a plurality of second bores, each second bore contiguous with and interconnecting the respective first bore and the respective hole each enlarged element is sized to be receivable by the respective first bore and to be unable to pass through the respective second bore and the respective hole.

2. The resistance exercise device of claim 1 wherein each tube defines a channel at the one end of the tube and wherein each of the enlarged elements comprises a plug, each plug received by the channel of the respective tube expanding a portion of the respective tube, each plug being sized such that the expanded portion of the respective tube is unable to pass through the respective hole.

3. The resistance exercise device of claim 1 wherein each second bore is sized to receive the respective tube but unable to receive at least a portion of the respective enlarged element.

4. The resistance exercise device of claim 1 wherein each first bore is wider than the respective second bore.

5. The resistance exercise device of claim 1 wherein each enlarged element is generally tubular and each first bore and each second bore have a diameter, the diameter of each first bore and the diameter of each enlarged element are greater than the diameter of each second bore.

6. The resistance exercise device of claim 1 wherein each handle defines a plurality of first bores, each first bore contiguous with the respective hole, wherein each tube defines a channel at the one end of the cord, and wherein the structure comprises a plurality of plugs, each plug received by the channel of a respective tube expanding a portion of the respective tube, each tube received by a respective first bore and the respective hole adjacent the one end of the tube, each plug is sized such that the expanded portion of the respective tube is receivable by the respective first bore and is unable to pass through the respective hole.

7. The resistance exercise device of claim 6 wherein each first bore and each plug has a diameter, and each hole is generally circular, the diameter of each first bore and the diameter of each plug are greater than the diameter of each hole.

8. The resistance exercise device of claim 6 wherein the handle defines a plurality of second bores, each second bore contiguous with and interconnecting the respective first bore and the respective hole, each tube received by a respective second bore adjacent the one end of the tube, each second bore is sized to receive the respective tube but unable to receive at least a portion of a respective plug.

9. The resistance exercise device of claim 6 further comprising a plurality of sleeves, each sleeve disposed about the expanded portion of the respective tube.

10. The resistance exercise device of claim 1 further comprising an other handle secured to the other end of the cord.

11. The resistance exercise device of claim 1 wherein there are four of the tubes.

12. The resistance exercise device of claim 1 wherein the tubes are conjoined together by said means of braiding such that the tubes are snug along substantially the entire length of the cord when the cord is in the relaxed state.

13. The resistance exercise device of claim 1 wherein the tubes are conjoined together by said means of braiding such that when the cord is in the relaxed state each of the tubes is in contact with at least one of the other tubes substantially along the entire length of the cord when the cord is in the relaxed state.

14. The resistance exercise device of claim 1 wherein each of the tubes is hollow along substantially its entire length.

15. The resistance exercise tube of claim 1 wherein the handle is slidable relative to the tubes.

16. A resistance exercise device comprising:

at least one handle defining a plurality of holes, a plurality of first bores having first bore diameters, and a plurality of second bores having second bore diameters smaller than the first bore diameters, each second bore contiguous with and interconnecting a respective first bore and a respective hole;

a cord having a pair of ends and a length extending between the pair of ends, the cord being stretchable from a relaxed state to extend the length of the cord, the cord comprising a plurality of tubes extending substantially the entire length of the cord, the tubes being conjoined together along substantially the entire length of the cord by means of braiding, each tube received by the respective hole of the handle and the respective first and second bores, each tube defines a channel at the one end of the cord; and a plurality of plugs for securing the handle to one end of the cord, each plug received by the channel of a respective tube expanding a portion of the respective tube to a dimension greater than the second bore diameters but less than the first bore diameters, the expanded portion of the respective tube receivable by the respective first bore, each plug sized to prevent the respective tube from disengaging from the handle by preventing the expanded portion of the respective tube from passing through the respective second bore.

17. The resistance exercise device of claim 16 wherein the handle further comprises a rim defining the plurality of first and second bores, each rim separating the respective first bore from the respective second bore and engaging the expanded portion of the respective tube.

* * * * *